US006392203B1

(12) United States Patent
Schmidmayer

(10) Patent No.: US 6,392,203 B1
(45) Date of Patent: May 21, 2002

(54) BAKING OVEN WITH BAKING OVEN MUFFLE

(75) Inventor: Gerhard Schmidmayer, Bad Endorf (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/671,826

(22) Filed: Sep. 27, 2000

Related U.S. Application Data

(63) Continuation of application No. PCT/EP99/02061, filed on Mar. 26, 1999.

(30) Foreign Application Priority Data

Mar. 27, 1998 (DE) ..... 198 13 787

(51) Int. Cl.[7] ..... A21B 1/22; A47J 36/02
(52) U.S. Cl. ..... 219/405; 219/391; 126/19 R
(58) Field of Search ..... 219/405–407, 219/409–411, 391; 126/19 R, 273 R; 148/275

(56) References Cited

U.S. PATENT DOCUMENTS 2,537,433 A * 1/1951 Waring ..... 126/19 R
3,816,702 A * 6/1974 Green ..... 219/406
3,979,575 A * 9/1976 Maahs ..... 219/407
4,298,789 A * 11/1981 Eichelberger et al. ..... 219/406
4,880,952 A * 11/1989 Hirai et al. ..... 219/407
5,616,266 A * 4/1997 Cooper ..... 219/407
6,054,227 A * 4/2000 Greenberg et al. ..... 126/19 R

FOREIGN PATENT DOCUMENTS

JP 6-145946 * 5/1994
JP 11-118078 * 4/1999

* cited by examiner

*Primary Examiner*—Joseph Pelham
(74) *Attorney, Agent, or Firm*—Herbert L. Lerner; Laurence A. Greenberg; Werner H. Stemer

(57) ABSTRACT

A baking oven includes a metallic baking oven muffle that can be closed off on a front side by a door. The muffle walls have heating elements for heating the cooking chamber to over approximately 180° C. and/or for heating the food disposed therein to be cooked. The muffle has a protective layer covering the muffle walls at least on the inner side. To improve the use properties of the baking oven muffle, the thickness of the protective layer is less than approximately 30 $\mu$m. The protective layer is formed as a hard sol-gel layer having a thickness of approximately 10 $\mu$m, preferably, between approximately 5 and 10 $\mu$m. The protective layer is transparent. The inner sides of the muffle serve as a reflector. A functional sol-gel layer is disposed on the hard sol-gel layer. The functional sol-gel layer has a thickness of approximately 10 $\mu$m, preferably, 2 to 3 $\mu$m. When the muffle is aluminum, the protective layer is an anodized aluminum oxide layer. The heating elements are applied to an insulating protective layer with thick-film technology. A stabilizing frame is substantially formed by the baking-oven muffle insulation. The frame supports the muffle on its outside. A muffle wall thickness is approximately 0.3 to 0.5 mm, preferably, 0.4 mm. Protective layer thickness is less than 20 $\mu$m, preferably, between approximately 5 and 10 $\mu$m.

15 Claims, 1 Drawing Sheet

BAKING OVEN WITH BAKING OVEN MUFFLE

CROSS-REFERENCE TO RELATED APPLICATION

This is a continuation of copending International Application PCT/EP99/02061, filed Mar. 26, 1999, which designated the United States.

BACKGROUND OF THE INVENTION

FIELD OF THE INVENTION

The invention lies in the field of appliances. The invention relates to a baking oven with a metallic baking oven muffle that can be closed off on the front side by a door. The muffle walls have heating elements for heating the cooking chamber to over approximately 180° C. and/or for heating the food to be cooked. The muffle walls have a protective covering layer at least on an inner side.

A baking oven having an enamel-layered oven muffle is generally known. The enamel coating serves to resist both corrosion and oxidation. Furthermore, the layer of enamel makes the baking oven muffle easier to clean and increases the surface hardness. Finally, the enamel determines the optical properties of the baking oven muffle. The enamel has these attributes at layer thicknesses of typically 100 to 200 μm. Drawbacks of such enamel protective layers include, in particular, brittleness. Another drawback is that the tensile and compressive stresses, resulting from the different coefficients of expansion of enamel and muffle material, may lead to component deformation, cracks, or flaking of the enamel.

SUMMARY OF THE INVENTION

It is accordingly an object of the invention to provide a baking oven with baking oven muffle that overcomes the hereinafore-mentioned disadvantages of the heretofore-known devices of this general type and that improves the use properties of the baking oven muffle.

With the foregoing and other objects in view, there is provided, in accordance with the invention, a baking oven, including a metallic baking oven muffle having a front side and muffle walls defining a cooking chamber and inner sides, a door for closing off the front side of the muffle, heating elements for at least one of heating the cooking chamber to over approximately 180° C. and heating food to be cooked, the heating elements disposed at the muffle walls, and a protective layer covering the muffle walls at least on the inner sides, the protective layer being transparent and having a thickness less than approximately 30 μm, the inner sides serving as a reflector.

In accordance with another feature of the invention, the protective layer is formed as a hard sol-gel layer.

According to the invention, improvement in the oven's use properties is achieved by the fact that the thickness of the protective layer is less than approximately 30 μm, in particular, less than 20 μm and, preferably, between approximately 5 and 10 μm. Due to the small layer thickness, only slight stresses occur in the muffle wall. Furthermore, very good thermal conduction from the heating elements or the muffle wall to the interior of the muffle is ensured and the protective layer is relatively unsusceptible to cracks and/or there is little likelihood of flaking. The thin protective layer also constitutes sufficient protection against corrosion and oxidation and gives a hard surface protection for the metal.

In a simple process, thin protective layers of this nature may preferably be produced using a sol-gel technique. As such, the sol-gel layer can be applied to the muffle walls using, for example, a simple dipping process. In particular, with the sol-gel technique, the low firing temperatures of approximately 450 to 500° C. are favorable compared to the enameling technique. Also, the sol-gel layers applied are suitable for the temperatures typically used during cooking.

Preferably, the thickness of the hard layer is approximately 10 μm, particularly, from 5 to 10 μm.

According to a preferred embodiment, the protective layer is transparent and the inner side of the muffle wall serves as a reflector. The configuration is advantageous, in particular, if cooking is carried out using thermal radiation in the infrared range or in the visible light range. Transparent layers of this nature can be formed as sol-gel layers without problems.

In accordance with a further feature of the invention, there is also provided a functional sol-gel layer disposed on the hard sol-gel layer.

To further improve the use properties of the baking oven muffle, a functional sol-gel layer is provided on the hard sol-gel layer. As such, it is possible for different regions of the muffle walls to be provided with particular properties. The properties may, for example, include particularly simple cleaning, a special sliding characteristic, or catalytic properties. The functional layer is advantageously produced as a layer that is approximately 10 μm thick, in particular, approximately 2 to 3 μm thick. Due to the sol-gel technique used, the layers applied, despite their low thickness, exhibit a high level of stability and good adhesion both on one another and on the metal.

In accordance with an added feature of the invention, the functional sol-gel layer is made of different functional sol-gel layers that are disposed on different surface regions of the muffle walls.

In accordance with an additional feature of the invention, the muffle is aluminum. If the baking oven muffle is made of aluminum, the protective layer may be produced as an anodized, in particular, hard-anodized, aluminum oxide layer. The oxide layer is distinguished, in particular, by its excellent hardness and smoothness.

In accordance with yet another feature of the invention, at least part of the muffle walls has an insulating protective layer, and the heating elements are applied to the insulating protective layer with thick-film technology.

Particularly good heat transfer from the heating element to the muffle wall or to the cooking chamber and excellent heat distribution in this respect can be achieved if the muffle wall has an insulating protective layer in the μm range. The heating element is applied directly to the muffle wall by thick-film technology. If appropriate, the heating element may also be formed using more complex coating processes, for example, the thin-film technique.

In accordance with yet a further feature of the invention, the thickness of the muffle walls is approximately 0.3 to 0.5 mm, particularly, 0.4 mm.

Due to the thin protective layers, when the baking oven muffle is heated, there are only slight stresses produced in the baking oven muffle despite the different coefficients of thermal expansion of the protective layer and the muffle wall. Therefore, the thickness of the muffle wall can also be reduced to, for example, approximately 0.4 mm.

According to a preferred embodiment, the stabilizing frame is essentially formed by the baking oven insulation.

On one hand, the insulation has to be sufficiently resilient to be able to follow the increase in volume of the baking oven muffle during heating, and, on the other hand, the insulation has to be sufficiently strong to be able to sufficiently stabilize the thin-walled baking oven muffle.

According to a concomitant embodiment, the baking oven muffle is supported from the outside by a stabilizing frame. Such stabilization is important, in particular, when the thickness of the muffle wall is only approximately 0.3 to 0.5 mm. The virtual halving of the wall thickness of the baking oven muffle compared to the prior art also considerably improves the heat-up times and the heat distribution. In addition, the small material thickness enables lowers and saves material costs. Moreover, the weight of the baking oven muffle is considerably reduced.

Other features that are considered as characteristic for the invention are set forth in the appended claims.

Although the invention is illustrated and described herein as embodied in a baking oven with baking oven muffle, it is, nevertheless, not intended to be limited to the details shown since various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
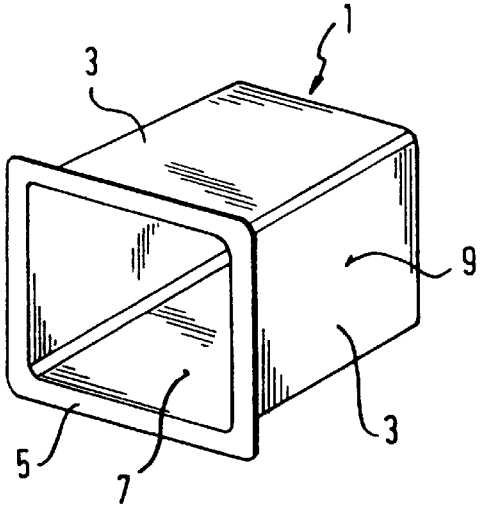
FIGS. 1 to 4 are diagrammatic, frontal, perspective views of production process steps of the baking oven muffle according to the invention.

In all the figures of the drawing, sub-features and integral parts that correspond to one another bear the same reference symbol in each case.

Figure 2:
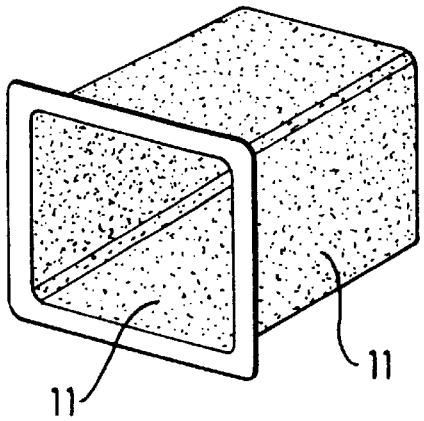

Referring now to the figures of the drawings in detail and first, particularly to FIG. 1 thereof, there is shown a cuboid-shaped baking oven muffle 1 made from stainless steel with five muffle walls 3, namely the two side walls, a bottom wall, a top wall, and a non-illustrated back wall. A muffle flange 5 surrounds the loading opening of the baking oven muffle 1. The baking oven muffle 1 is produced in one piece in a hydroforming process. During the deep-drawing process, the baking oven muffle does not exhibit defects that are found in conventional, mechanically deep-drawn parts, such as uneven and considerable changes in wall thickness, visible drawing tracks and drawing beads, reduced surface quality, and reduced dimensional accuracy. Using sol-gel technology, a muffle inner side 7 and a muffle outer side 9 are coated with a sol-gel layer 11 in a dipping or spraying process (see FIG. 2). In the process, a colloidal system in the micrometer range (gel) is generated from a solution (sol) by controlled condensation methods. The gel is solidified by drying as a result of the extraction of solvent. Then, the gel is suitably hardened or fired at a temperature of approximately 450 to 500° C. During the hardening/firing process, the sol-gel layer is particularly firmly joined to the substrate through chemical bonds. The resultant sol-gel layer is approximately 10 $\mu$m thick and forms a hard surface with electrically insulating properties on both sides of the stainless steel muffle wall 3. Furthermore, the sol-gel layer protects the stainless steel against tarnishing and oxidation.

In at least one further process step using the sol-gel technique, functional layers are applied to the hard sol-gel layer on different regions of the muffle inner side 7. Depending on the location in the baking oven muffle 1, the functional sol-gel layers provide, in particular, nonstick, sliding, and catalytic properties. The thickness of the functional sol-gel layers is approximately 3 $\mu$m. The protective layer formed from the two sol-gel layers 11 is transparent such that the thermal radiation relevant to the preparation of dishes, in the infrared or the visible light range, can penetrate through the protective layer and can be optimally reflected by the stainless steel surface into the interior of the muffle (see FIG. 2). If required, transparent or opaque coloring of the layers is also possible.

Figure 3:
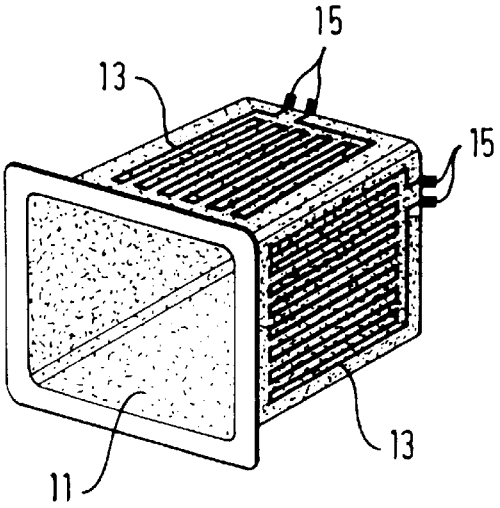

In a subsequent process step, meandering heating conductors 13 are applied to the hard sol-gel layer on the muffle outer side 9 using a thick-film technique (see FIG. 3). Particularly good and uniform heat transfer between the heating conductor 13 and the muffle wall 3 is possible due to the particularly thin insulating layer. The heating conductors 13 may be supplied with electric voltage through conductor connectors 15.

Figure 4:
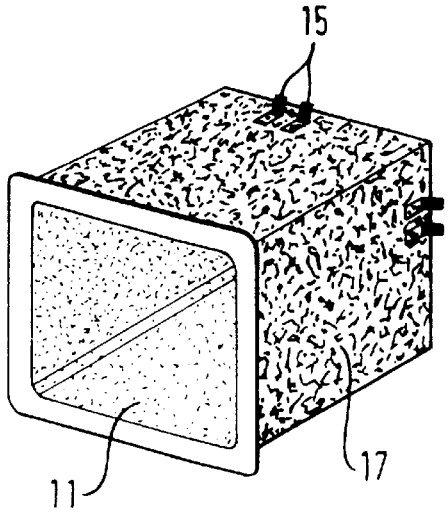

Finally, as shown in FIG. 4, the baking oven muffle 1 is embedded in muffle insulation 17 made from fiber-free insulating material, e.g., perlite. The insulating casing stabilizes the baking oven muffle 1. The wall thickness of the casing is only 0.4 mm. Furthermore, the insulating shell 17 is made sufficiently resilient to ensure that it does not crack during the thermal expansion of the baking oven muffle 1 as it is heated during a cooking operation.

I claim:

1. A baking oven, comprising:

a metallic baking oven muffle having a front side and muffle walls defining a cooking chamber and inner sides;

a door for closing off said front side of said muffle;

heating elements for heating said cooking chamber disposed at said muffle walls;

a protective hard sol-gel layer covering said muffle walls at least on said inner sides, said protective layer being transparent and having a thickness less than approximately 30 $\mu$m, said inner sides serving as a reflector; and a functional sol-gel layer disposed on said hard sol-gel layer.

2. The baking oven according to claim 1, wherein said functional sol-gel layer is different functional sol-gel layers, said muffle walls have surface regions, and said different functional sol-gel layers are disposed on different ones of said surface regions.

3. The baking oven according to claim 1, wherein said muffle is aluminum, and said protective layer is an anodized aluminum oxide layer.

4. The baking oven according to claim 1, wherein said hard sol-gel layer has a thickness of approximately 10 $\mu$m.

5. The baking oven according to claim 1, wherein said hard sol-gel layer has a thickness between approximately 5 and 10 $\mu$m.

6. The baking oven according to claim 1, wherein said functional sol-gel layer has a thickness of approximately 10 $\mu$m.

7. The baking oven according to claim 1, wherein said functional sol-gel layer has a thickness of approximately 2 to 3 $\mu$m.

8. A baking oven, comprising:

a metallic baking oven muffle having a front side and muffle walls defining a cooking chamber and inner sides;

a door for closing off said front side of said muffle;

heating elements for heating said cooking chamber disposed at said muffle walls;

a protective layer covering said muffle walls at least on said inner sides, said protective layer being transparent and having a thickness less than approximately 30 $\mu$m, said inner sides serving as a reflector;

at least part of said muffle walls having an insulating protective layer; and said heating elements being applied to said insulating protective layer with thick-film technology.

9. A baking oven, comprising:

a metallic baking oven muffle having a front side and muffle walls defining a cooking chamber, outer sides, and inner sides;

a door for closing off said front side of said muffle;

heating elements for heating said cooking chamber disposed at said muffle walls;

a protective layer covering said muffle walls at least on said inner sides, said protective layer being transparent and having a thickness less than approximately 30 $\mu$m, said inner sides serving as a reflector;

at least part of said outer sides having an insulating protective layer; and said heating elements being applied to said insulating protective layer with thick-film technology.

10. A baking oven, comprising:

a metallic baking oven muffle having a front side and muffle walls defining a cooking chamber, outer sides, and inner sides;

a door for closing off said front side of said muffle;

heating elements for heating said cooking chamber disposed at said muffle walls;

a protective layer covering said muffle walls at least on said inner sides, said protective layer being transparent and having a thickness less than approximately 30 $\mu$m, said inner sides serving as a reflector; and said heating elements being applied to said outer sides with thick-film technology.

11. A baking oven, comprising:

a metallic baking oven muffle having a front side and muffle walls defining a cooking chamber and inner sides;

a door for closing off said front side of said muffle;

heating elements for heating said cooking chamber disposed at said muffle walls;

a protective layer covering said muffle walls at least on said inner sides, said protective layer being transparent and having a thickness less than approximately 30 $\mu$m, said inner sides serving as a reflector; and a stabilizing frame substantially formed by a baking-oven muffle insulation, said muffle having an outside, and said frame supporting said muffle on said outside.

12. A baking oven, comprising:

a metallic baking oven muffle having a front side and muffle walls having a thickness and defining a cooking chamber and inner sides;

a door for closing off said front side of said muffle;

heating elements for heating said cooking chamber disposed at said muffle walls;

a protective layer covering said muffle walls at least on said inner sides, said protective layer being transparent and having a thickness less than approximately 30 $\mu$m, said inner sides serving as a reflector; and said thickness of said muffle walls being approximately 0.3 to 0.5 mm.

13. A baking oven, comprising:

a metallic baking oven muffle having a front side and muffle walls having a thickness and defining a cooking chamber and inner sides;

a door for closing off said front side of said muffle;

heating elements for heating said cooking chamber disposed at said muffle walls;

a protective layer covering said muffle walls at least on said inner sides, said protective layer being transparent and having a thickness less than approximately 30 $\mu$m, said inner sides serving as a reflector; and said thickness of said muffle walls being approximately 0.4 mm.

14. In combination with a baking oven having a door, a baking oven muffle, comprising:

metallic muffle walls defining a front side, a cooking chamber, and inner sides, said front side disposed to be closed off by the door;

heating elements for heating said cooking chamber disposed at said muffle walls; and a protective hard sol-gel layer covering said muffle walls at least on said inner sides, said protective layer being transparent and having a thickness less than approximately 30 $\mu$m, said inner sides serving as a reflector; and a functional sol-gel layer disposed on said hard sol-gel layer.

15. In combination with a baking oven having a door and heating elements for heating the oven, a baking oven muffle, comprising:

metallic muffle walls defining a front side and inner sides, said front side disposed to be closed off by the door; and a protective hard sol-gel layer covering said muffle walls at least on said inner sides, said protective layer being transparent and having a thickness less than approximately 30 $\mu$m, said inner sides serving as a reflector, the heating elements disposed at said muffle walls; and a functional sol-gel layer disposed on said hard sol-gel layer.

* * * * *